United States Patent [19]

Harsányi et al.

[11] Patent Number: 4,630,931

[45] Date of Patent: Dec. 23, 1986

[54] PROCESS AND APPARATUS FOR THE MIXING OF SLURRIES

[75] Inventors: József Harsányi, Budapest; Janos Pintér; Alajos Suri, both of Mosonmagyaróvár, all of Hungary

[73] Assignee: Magyar Aluminiumipari Troszt

[21] Appl. No.: 704,870

[22] Filed: Feb. 25, 1985

[30] Foreign Application Priority Data

Feb. 28, 1984 [HU] Hungary ..... 801/84

[51] Int. Cl.[4] ..... B01F 13/02

[52] U.S. Cl. ..... 366/107; 366/101

[58] Field of Search ..... 366/101, 106, 107, 136, 366/137, 341, 262, 266, 270, 184, 191; 406/133, 136–138, 127–130; 222/564, 547, 195; 414/288

[56] References Cited

U.S. PATENT DOCUMENTS

| | | | |
|---|---|---|---|
| 3,198,492 | 8/1965 | Schneider | 366/107 |
| 3,258,252 | 6/1966 | Lanier | 366/107 |
| 3,647,188 | 3/1972 | Solt | 366/107 |
| 4,128,343 | 12/1978 | Moked et al. | 366/101 |
| 4,185,926 | 1/1980 | Lyon | 366/101 |
| 4,478,517 | 10/1984 | Hoppe et al. | 366/341 |
| 4,486,101 | 12/1984 | Brar | 366/101 |
| 4,560,285 | 12/1985 | Fisher | 366/341 |

*Primary Examiner*—Timothy F. Simone

*Attorney, Agent, or Firm*—Karl F. Ross; Herbert Dubno

[57] ABSTRACT

A method of and apparatus for the mixing of a slurry in a tank having a conical bottom along the axis of the tank, and air-lift pipe is provided which is supplied at its lower end with compressed air to induce an upward flow of the slurry and air mixture through the pipe during start up of a mixing operation. Thus an injection is cut off when steady state is reached and air is injected at an upper level in the pipe located in the upper third of the length thereof but below the upper eighth for continuing mixing operation.

12 Claims, 7 Drawing Figures

PROCESS AND APPARATUS FOR THE MIXING OF SLURRIES

FIELD OF THE INVENTION

The invention relates to a process and an apparatus for the mixing of slurries.

BACKGROUND OF THE INVENTION

In a chemical industry, and in aluminum, gold and uranium ore processing plants compressed air operated mammoth-pipe (air-lift pump) fitted tanks with conical bottoms are used for the mixing and delivery of slurries. 300–1000 mm diameter mammoth pipes are arranged along the vertical axis of these tanks which frequently can have capacities of several thousand $m^3$.

Compressed air of higher pressure than the static pressure (slurry head) existing at the inlet site is injected through an inlet head into the lower zone of the air lift pipe extending to the conical bottom of the tank.

The 5–7 bar compressed air in the form of dispersed bubbles enters the air-lift pipe through hydraulically dimensioned ports. The slurry-air mixture—, overcoming the various resistances, is carried upwardly by the effect of the difference of specific weights, then overflows on the upper flange of the mammoth pipe, and at least a certain part of it returns to the tank. Thus the slurry flows into the mammoth pipe at the bottom, while it flows out at the top; as a result the full volume of the slurry in the tank is mixed, preventing the solid phase from settling. In case of series connected slurry mixing tanks the slurry can be delivered in several known ways so that the unmixed slurry admitted continuously into the first tank of the line should leave the last tank in the state of mixed slurry.

The process described here has been generally used all over the world. The production of the 5–7 bar compressed air per 1000 $m^3$ tank generally requires 20 kW electric power and very costly air compressors.

The size of the bubbles formed at the inlet head ranges 3–20 mm in an industrial scale unit. The bubbles of different sizes and shapes move with different ascendant velocities, large bubbles overtaking smaller ones, and the increased-volume bubbles incorporate along their paths the smaller ones by way of chain-reaction. When the speed of the large bubbles in the mammoth pipes is higher than that of the slurry resulting in greater slip, i.e. the mammoth pipe efficiency is reduced. The efficiency is likewise lowered by the fact that the bubbles rise along a spiral path causing undesirable eddy currents. Consequently in the long, 20–40 m high mammoth pipe used in the practice, the local efficiency diminishes upwards at a continuous rate, and on the outlet level it is not even 10%.

OBJECT OF THE INVENTION

The object of the present invention is to provide an improved process and apparatus for the mixing of slurries, which eliminate the detrimental eddying of the rising slurry at a compressed air pressure much lower than has been required to date.

SUMMARY OF THE INVENTION

This object is achieved, according to the invention, in that during the process, when the slurry is admitted into a mixing tank fitted with conical bottom, it is passed at least once through the air-lift pipe extending into the lower zone of the tank, then it is removed from the tank.

Within the tank, the slurry is mixed by injecting compressed air of higher pressure than the static pressure of the slurry into the air-lift pipe at its lower end during the start of the mixing operation. At the end of the starting period, when the mixing process and the progress of the slurry has become stationary, i.e. a steady state is achieved, according to the invention the inflow of the compressed air through the bottom of the mammoth pipe is stopped and the compressed air is injected into the zone between the upper third and eighth part of the mammoth pipe. The pressure of this compressed air is higher than the static pressure existing in the location of the inlet, but lower than the compressed air injected through the lower zone, i.e. is generally 0.5–2.5 bar, preferably 1.3–1.8 bar. The lower injection can be periodically switched on during operation.

The process according to the invention is essentially based on the recognition that same if the air inlet head is raised in the mammoth pipe. i.e. the path of the solid-liquid-air phase is shortened, then the air bubbles of varying size and geometry can no longer coalesce along the shorter upward movement of 2.5–10 m depending on the tank size. Thus no eddying, or hardly any eddying will occur and a solid-liquid phase free of bubbles flows upward in the longer zone of the mammoth pipe below the upper air inlet head, in which no detrimental eddying will occur. Consequently the hydraulic resistance is lower, which makes enables a saving of energy. By raising the air inlet head, lower pressure of air will be sufficient since the height of the slurry column above the inlet head will be reduced to $\frac{1}{3}$–$\frac{1}{8}$th of the original one.

The upper compressed air inlet head is usable only in the tank full with slurry. No mixing with the upper head takes during filling and draining of the tank. Therefore the original compressed air inlet head arranged in the lower zone is retained and it is operated only during filling and draining, but closed in steady-state operation.

The apparatus according to the invention is a tank with conical bottom and the air-lift or mammoth pipe arranged in the middle part, the lower zone of which is provided with lower inlet head connected to the compressed air hose. According to the invention an additional upper inlet head is connected to the compressed air hose between the upper third and eighth part of the mammoth pipe. The upper inlet head is connected to a hose of lower pressure than that of the compressed air hose at the lower inlet head, and shut-off devices, e.g. valves, are arranged between the inlet heads and the hoses.

The upper inlet head can be constructed in several ways: it may be formed as a star consisting of a perforated air supply arm tilting toward the circumference, it may be a perforated torus surface or a tray with downturned flange, on the practically vertical flange of which upwardly narrowing notches are formed all round.

The upper inlet head may be shaped in such a way too, that it is a perforated section of the air-lift pipe along the horizontal cross section thereof, which is surrounded by a jacket closed above and open below the perforation.

BRIEF DESCRIPTION OF THE DRAWING

The invention is described in detail by way of example with the aid of the accompanying drawings in which.

SPECIFIC DESCRIPTION

Figure 1:
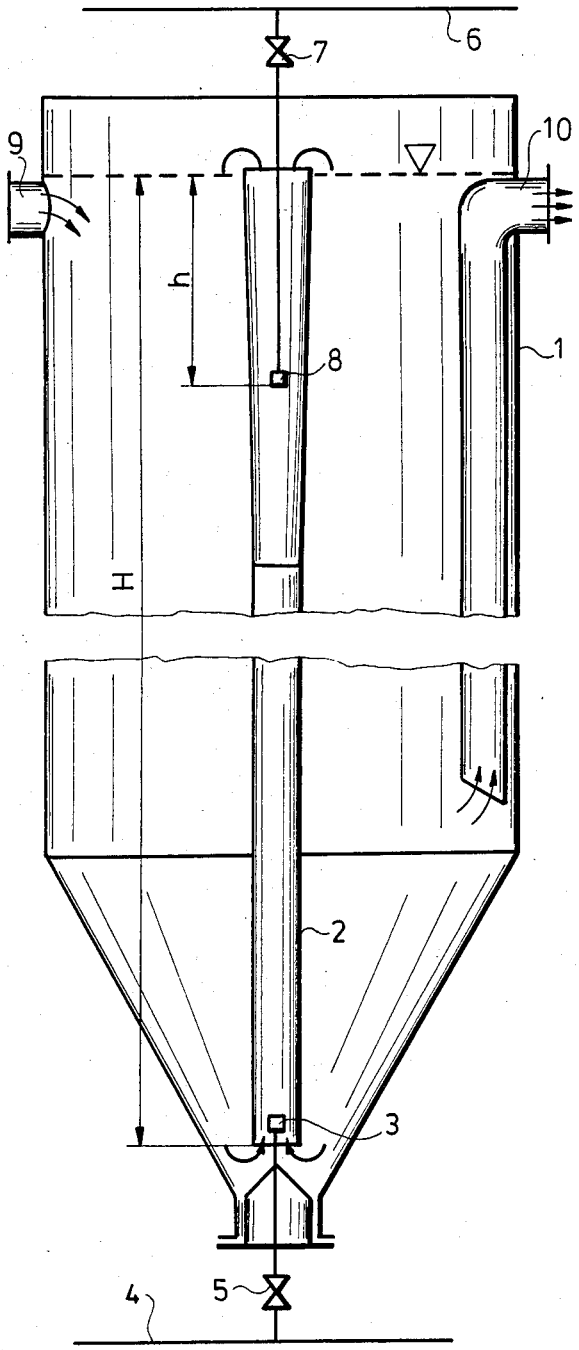
FIG. 1 is a vertical section of the slurry mixing tank fitted with conical bottom provided with mammoth pipe and upper inlet head according to the invention.

In the drawing an air-lift pump in the form of a mammoth pipe 2 of length H can be seen to be arranged along the vertical axis of the slurry mixing tank 1 fitted with conical bottom. In the lower zone of the pipe 2*a* lower inlet head 3 is arranged in a known manner. The lower inlet head 3 is connected through shut-off device 5 to a high-pressure compressed air hose 4. Slurry inlet stub 9 is formed in the vicinity of the upper flange of the tank, and slurry outlet stub 10 opposite the former one. Upper inlet head 8 according to the invention is arranged in the zone between the upper third and eighth part of the mammoth pipe at a depth h from the upper flange of the mammoth pipe. The upper inlet head 8 is connected through shut-off device 7 to a low pressure compressed air hose 6.

Figure 2:
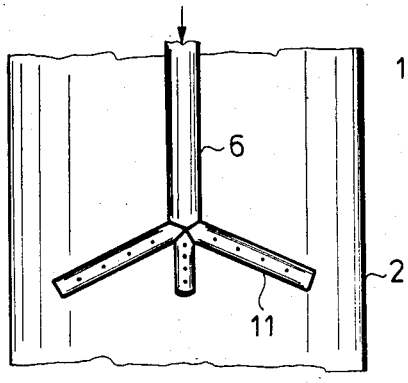
FIGS. 2 to 7 are vertical sections of alternative constructions of the upper inlet head.
Figure 3:
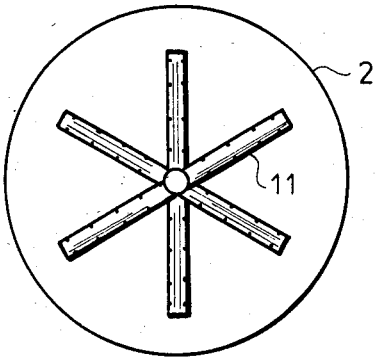

The upper inlet head 8 according to the invention may be of varying construction. In the construction shown in FIGS. 2 and 3, the upper inlet head 8 is formed as a star consisting of six air supply arms 11. The air supply arms 11 are made of tube tilting toward the circumference of the star and perforated throughout. The end of the air supply arms 11 may be closed or perforated.

The air supply system of star arrangement is applicable mainly in case of slurry/liquid tanks fitted with small diameter mammoth pipe, with the absorption of small amount of air. Its advantage is the uniform air bubble distribution.

Figure 4:
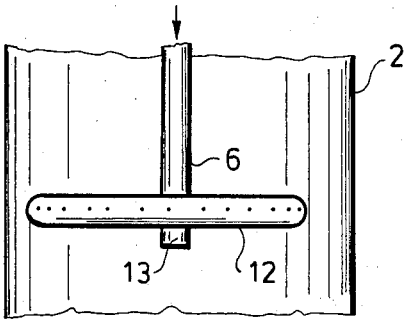

According to the construction shown in FIG. 4 the upper inlet head 8 is ended in a horizontal torus 12 perforated all round. The bottom of this inlet head may be formed as an open pipe stub 13.

The air supply device of torus system is applicable for mixing of slurries with low solids content which are slightly susceptible to settling and separation when medium amount of air is absorbed. Its advantage is its simple construction and the possibility of fast replacement.

Figure 5:
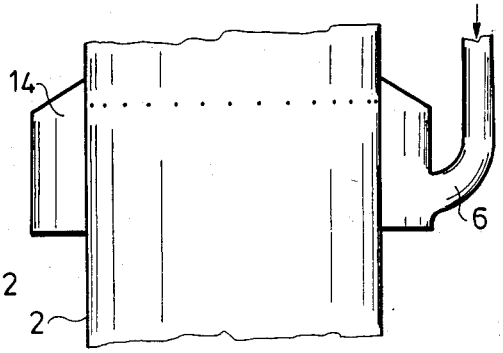

The upper inlet head 8 shown in FIG. 5 is formed on the mammoth pipe 2 with perforations along the horizontal cross section of the mammoth pipe, as well as a jacket 14 closed above and open below the perforations surrounding this short zone of the mammoth pipe 2. The low pressure compressed air hose 6 in this case is connected below the jacket 14 outside the mammoth pipe 2.

The external air supply system of this type is used preferably in case of slurries flowing at high speed, since there is no hydraulic resistance. Its drawback compared to the other alternatives is that its cleaning is difficult during operation. Consequently it can be used only for the mixing of slurries containing limited amount of impurity, not susceptible to separation.

In the above three types of air inlet head the perforation may be circular or any other shape and each hole may have a cross section of 3–18 $mm^2$.

Figure 6:
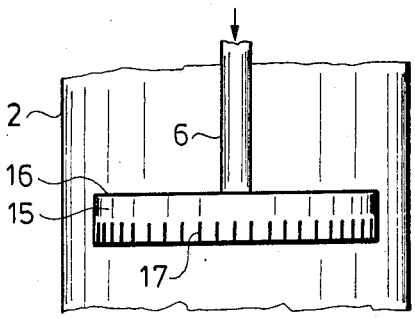
Figure 7:
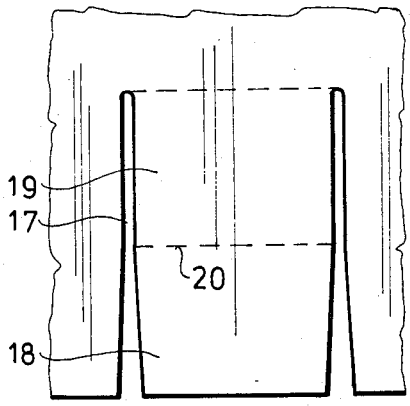

The upper inlet head 8 shown in FIGS. 6 and 7 is formed as a tray 16 with down-turned flange 15 on the lower end of the compressed air hose 6 extending downward along the axis of the mammoth pipe 2. The practically vertical flange 15 of the upper inlet head 8 is provided with upwardly narrowing notches 17. The shape of the flange part 19 between the notches 17 may be triangle, or trapezoidal, or rectangle ending in trapezoid 18 as shown in FIG. 7.

The air supply device with vertically slit holes is used to advantage in the mixing of slurries with high solid content, because the solid grains can be removed through the holes cut out to the lower plane of the air supply device. This is desirable mainly in the alumina industry. It has the further advantage is that it is self-cleaning, because the impurities deposited from the technological medium onto the air supply device are wiped off by expansion of the gas phase flowing at high speed along the slit jacket. Thus the size of bubbles remains constant during the operating cycle of the tank providing continuous high efficiency of the mammoth pump.

During the process according to the invention when the tank 1 is full with slurry, it flows through the slurry inlet stub 9 into the tank 1 at continuous rate, from where it is continuously discharged through the slurry outlet stub 10 for further processing. The shut-off device 5 of the high pressure compressed air hose 4 is closed, and the shut-off device 7 of the low pressure compressed air hose 6 is opened. The low pressure compressed air, at a pressure of 0.5–2.5 bar (depending on the depth h between the surface of the slurry in tank 1 and the inlet head 8, (FIG. 1), on the specific weight of the slurry and on the flow zones) passes through the perforations (FIGS. 2 to 5) or notches 17 (FIGS. 6 and 7) of the upper air inlet head into the slurry in the mammoth pipe 2.

After a short upward flow it forms a homogeneous solid-liquid-air phase, which moves along section h of mammoth pipe 2 upwardly and overflows on the upper flange of the mammoth pipe 2. There is a solid-liquid phase free from air in the zone H-h of the mammoth pipe 2, which flows upward without eddy like a piston. During starting (filling) and stopping (draining) the upper inlet head 8 would not be capable to mix the slurry, hence the shut-off device 7 is closed, at the same time the shut-off device 5 is opened; thus for this period the air passes into the slurry in the lower zone of the mammoth pipe 2, and mixes it locally, preventing the solid phase from settling. Even in stationary operation mode it is advisable to open the shut-off device 5 for example for half an hour each week, in other words to carry out the so-called coning draft, whereby the large crystals forming as by-product are removed from the bottom of the tank 1.

The invention is described by way of examples as follows:

EXAMPLE 1

An alumina factory-type slurry of aluminate liquor and seeding material is mixed in a system of 1000 $m^3$ capacity mixing tanks. Diameter of the tanks is 7 m, height 25 m, the cone angle of the lower conical end part is 60°. The tanks are fitted with mammoth pipe mixers, the flow rate of which is 500 $m^3/h$ and the delivery height (above the liquid level of the tank) is 20 cm. Each mammoth pump has a 4.5 bar high pressure and 1.5 bar low pressure system. The air output of the high pressure system is 150 $Nm^3/h$, the size of the air bubbles is 5–15 mm at the exit. The air output of the low pressure system is 180 $Nm^3/h$, the size of the air bubbles is 2–10 mm at the exit. The air inlet of the low pressure system is a torus-type air inlet as shown in FIG. 4, the diameter of which is 270 mm and provided with 40 pieces of 2.5 mm diameter air supply holes. The air inlet is arranged at a depth of 5 m from the liquid level.

A slurry of aluminate liquor and seeding material, the temperature of which is 60° C. and the density 1.4 $g/cm^3$ is admitted at the rate of 400 $m^3/h$ into a series connected mixing system consisting of twenty tanks as discribed above. The solid content of the slurry is 300 g/l, the grain size of which is 40–80 μm. At the beginning of the mixing the high pressure system is switched on by opening the valves 5. Meanwhile the valves 7 are closed. Upon the lapse of 55 hour running time, the stationary state sets in. At this stage the high pressure system is switched off by closing the valves 5 and the low pressure system is started up by opening the valves 7. The mixing further on is carried out with operation of the low pressure system.

The power requirement of the low pressure system is 6 kWh/h, representing 50% of the power requirement of a high pressure system. The coning draft (agitation of settlings) required by the technology is ensured by switching on the high pressure system for 1 hour after 200 h running time.

EXAMPLE 2

Alumina factory-type slurry of aluminate liquor and seeding material is mixed in a system of 2000 $m^3$ capacity tanks. Diameter of the tanks is 10 m, height 33 m, the bottom of the tanks is formed with a cone of broken generatrix built up with 3 truncated cone elements. The tank is fitted with mammoth pump, the flow rate is 1000 $m^3/h$, delivery height (above the liquid level) is 30 cm. The mammoth pump is provided with a 5.5 bar high pressure and 1.8 bar low pressure system. The air output of the high pressure system is 250 $Nm^3/h$, the size of the air bubbles is 5–15 mm at the exit. The air output of the low pressure system is 280 $Nm^3/h$, the size of bubbles is 2–10 mm. The air inlet of the low pressure system is a vertically slit self-cleaning air injector as shown in FIGS. 6 and 7. Its diameter is 300 mm, the upper size of the slits is 0.5 mm, the lower width 10 mm, length 80 mm. Ten slits are arranged on the jacket. The air inlet is arranged at a depth of 9 m from the liquid level.

Alumina factory-type slurry of aluminate liquor and seeding material is admitted at the rate of 800 $m^3/h$ into the mixing system containing series connected 24 pieces of tank as described earlier. The characteristics of the slurry are the same as those given in example 1. At the beginning of the mixing the high pressure system is started by opening the valves 5, while the valves 7 are closed. The stationary state sets in after 100 h running time. At this stage the high pressure system is switched off by closing the valves 5, and the low pressure system is started by opening the valves 7. The mixing is carried on with the low pressure system, the power consumption of which is 11 kWh/h.

EXAMPLE 3

Uranium ore slurry is recovered in uranium industrial 400 $m^3$ capacity mixing tanks fitted with conical bottom. The tanks are provided with mammoth pump mixer. The flow rate of the pump is 400 $m^3/h$, delivery height (above the liquid level) 40 cm. The inside diameter of the recovery tanks is 4.5 m, height 16 m, the cone angle of the conical bottom is 60°.

The mammoth pump is provided with a 4 bar high-pressure and 1.3 bar low-pressure system. The amount of air in the high pressure system is 135 $Nm^3/h$, the bubble size 5–15 mm, the amount of air in the low-pressure system is 160 $Nm^3/h$, the bubble size 2–10 mm. The air inlet of the low-pressure system is an external air injector as shown in FIG. 5, provided with 20 pieces of 4 mm diameter air inlet holes arranged on the jacket. The air inlet is arranged at a depth of 4.5 m below the liquid level.

Uranium ore slurry of 90° C. temperature and 1.6 $g/cm^3$ density is admitted at the rate of 300 $m^3/h$ into a recovery system consisting of 16 series connected tanks as described earlier. The solid content of the slurry is 800 g/l. The high-pressure system is switched on at the beginning of the recovery. After 45 h running time the high-pressure system is switched off by shutting the valves 5, and the low-pressure system is started by opening the valves 7. The recovery is carried on with the low-pressure system, the power requirement of which is 5.5 kWh/h.

The data of the above examples are listed in Table I., showing the data of a conventional 1000 $m^3$ capacity tank as well for the purpose of comparison. The data clearly demonstrate that the same output with substantially lower energy utilization can be realized with the process and apparatus according to the invention.

Further advantage of the process according to the invention is that the saving of energy is much higher during operation, and the compressor requires lower pressure than the processes known so far.

TABLE I

| Data | Conventional | Example 1. | Example 2. | Example 3. |
|---|---|---|---|---|
| Cubic capacity of the tank /$m^3$/ | 1000 | 1000 | 2000 | 400 |
| Height of upper air inlet below the upper flange of the mammoth pipe /m/ | — | 5 | 9 | 4.5 |
| Flow rate of slurry in the tank /$m^3/h$/ | 400 | 400 | 800 | 300 |
| Average solid content of the slurry /g/l/ | 600 | 300 | 300 | 800 |
| Compressed air pressure in the upper inlet system /bar/ | — | 1.5 | 1.8 | 1.3 |
| Specific volume of compressed air required for mixing of the slurry /$Nm^3/h$/slurry $m^3$/ | 0.48–0.51 | 0.18 | 0.125 | 0.4 |
| Total air consumption per tank /$Nm^3/h$/ | 190–230 | 180 | 250 | 160 |
| Electric power consumption per tank /kWh/h/ | 11–21 | 6 | 11 | 5.5 |
| Electric power required for mixing slurry of unit volume /kWh/$Nm^3$/ | 0.09–0.14 | 0.006 | 0.0055 | 0.014 |

What we claim is:

1. A process for mixing a slurry, comprising the steps of:

introducing said slurry into a mixing tank having a conical bottom, an upright axis and a mixing pipe forming an air-lift pump extending axially in said tank and open at upper and lower ends in said tank;

injecting compressed air into said pipe at a first location close to said lower end for inducing an air-lift circulation of said slurry upwardly through said pipe by air lift action of said compressed air for a starting period of a mixing operation; and terminating at least for a part of a subsequent period of said mixing operation the injection of compressed air into said pipe at said first location, and injecting compressed air into said pipe at a second location above said first location and within an upper third of the length thereof but below an upper eighth of said length to effect air lift circulation of said slurry through said pipe for the balance of said mixing operation.

2. The process defined in claim 1 wherein said compressed air is injected at said second location at a pressure greater than the static head of said slurry at said second location but less than the pressure of the compressed air injected at said first location.

3. The process defined in claim 1 wherein said compressed air is injected at said second location at a pressure of substantially 0.5 to 2.5 bar.

4. The process defined in claim 3 wherein said compressed air is injected at said second location at a pressure of substantially 1.3 to 1.8 bar.

5. The process defined in claim 1 further comprising the step of periodically injecting compressed air into said pipe at said first location during said balance of said mixing operation.

6. An apparatus for mixing a slurry, comprising:

a mixing tank having a conical bottom, an upright axis and a mixing pipe forming an air-lift pump extending axially in said tank and open at upper and lower ends in said tank;

means for introducing a slurry into said tank;

means for injecting compressed air into said pipe at a first location close to said lower end for introducing an air lift circulation of said slurry upwardly through said pipe by air lift action of said compressed air for a starting period of a mixing operation; and means for injecting compressed air into said pipe at a second location above said first location and within an upper third of the length thereof but below an upper eighth of said length to effect air lift circulation of said slurry through said pipe for the balance of said mixing operation and upon termination of injection of compressed air at said first location.

7. The apparatus defined in claim 6 wherein said means for injecting compressed air into said pipe at a second location includes a hose at a compressed air pressure less than that of a hose forming said means for injecting compressed air into said pipe at a first location.

8. The apparatus defined in claim 7 wherein each of said means for injecting compressed air into said pipe includes a shutoff valve connected to the respective hose.

9. The apparatus defined in claim 7 wherein said means for injecting compressed air into said pipe at said second location is a head formed as a star consisting of perforated air supply arms inclined toward the circumference.

10. The apparatus defined in claim 7 wherein said means for injecting compressed air into said pipe at said second location includes a perforated torus at said second location.

11. The apparatus defined in claim 7 wherein said means for injecting compressed air into said pipe at said second location includes a perforated annular zone of said pipe at said second location surrounded by a jacket feeding compressed air to said zone.

12. The apparatus defined in claim 7 wherein said means for injecting compressed air into said pipe at said second location includes a tray with a downturned flange formed with upwardly narrowing notches around the flange.

* * * * *